United States Patent [19]

Beamer

[11] Patent Number: 4,917,182

[45] Date of Patent: Apr. 17, 1990

[54] SEALED TANK AND HEADER ASSEMBLY

[75] Inventor: Henry E. Beamer, Middleport, N.Y.

[73] Assignee: General Motors Corporation, Detroit, Mich.

[21] Appl. No.: 299,598

[22] Filed: Jan. 23, 1989

Related U.S. Application Data

[63] Continuation-in-part of Ser. No. 181,628, Apr. 1, 1988, abandoned.

[51] Int. Cl.[4] ..... F28F 9/02

[52] U.S. Cl. ..... 165/173; 165/149

[58] Field of Search ..... 165/149, 173, 175; 285/338, 349

[56] References Cited

U.S. PATENT DOCUMENTS 4,544,029 10/1985 Cadars ..... 165/149

FOREIGN PATENT DOCUMENTS 530876 8/1931 Fed. Rep. of Germany ..... 285/364

2353442 4/1975 Fed. Rep. of Germany ..... 165/173

*Primary Examiner*—Martin P. Schwadron

*Assistant Examiner*—Allen J. Flanigan

*Attorney, Agent, or Firm*—R. L. Phillips

[57] ABSTRACT

The joint between the tank and header of a heat exchanger comprises a channel formed in the header having an inner wall and a bottom, and a rim or foot on the mating edge of the tank. The space between the foot and the channel bottom and inner wall contains an elastomer gasket which is shaped to allow low assembly forces to deform the gasket and fill the space between the tank foot and header pocket, even when high hardness gasket material is used. The gasket includes an enlarged rib, like an O-ring, between the tank foot and header and an integral web portion extending from the rib into the space between the inner wall and the foot to fill and seal that area as well as the area at the bottom of the foot.

3 Claims, 1 Drawing Sheet

PRIOR ART

SEALED TANK AND HEADER ASSEMBLY

This is a continuation-in-part of U.S. Patent Application Ser. No. 181,628 filed Apr. 1, 1988, now abandoned.

FIELD OF THE INVENTION

This invention relates to a seal assembly for joining a tank and a header of a heat exchanger.

BACKGROUND OF THE INVENTION

Heat exchangers, particularly of the type used in automotive vehicles for engine cooling or heater purposes comprise a header and a tank at each end of the heat exchanger. It is vital that the junction of the tank and each header be leak-free, even over years of severe service and in the presence of somewhat corrosive fluids. It has become a practice to make the tanks of plastic or metal and join them to the metal headers. Thus it is important to provide sealing arrangements to joint tanks and headers subject to corrosive environments and temperature cycling in a manner to maintain seal integrity.

It is an accepted practice to use elastomer gaskets in the joints of the tanks and headers. Various rubbers such as EPDM or nitrile rubber are used for this purpose. The rubber is solid rather than foam and is used to fill the space between the tank and the header. Selecting an appropriate rubber with optimum properties usually involves tradeoffs. Important properties to consider are hardness, retained compression set and tear strength. Compression set is a measure of the ability of the material to spring back after being compressed. This quality is sought in such a seal so that when the joint expands due to temperature change the seal will remain tight. Tear strength has also proven to be important in certain joint designs where localized pressures in the assembly may cause the gasket to split or tear. Hardness affects the difficulty of deforming the material to fill the space in the joint and make good sealing contact. This difficulty directly determines the force required for assembly so that, for a given joint configuration, a high hardness can mandate a high force which creates stresses that are potentially damaging to the tank, the header and the gasket itself. An example of a hard rubber is EPDM rubber in its natural state which has a durometer of 60 or more. To soften the rubber for easier deformability oils are mixed with the rubber to reduce its durometer to 50. Then the tear strength and compression set are likewise reduced. In addition, the gaskets formed of soft elastomers tend to be limp and are difficult to manage during assembly operations whereas the harder elastomer products are stiffer and easier to handle. These tradeoffs have influenced the joint designs of prior tank to header assemblies.

Usually the joint designs have some sort of channel formed in the header plate to receive edge portions of the tank and the elastomeric seal is clamped between them. FIG. 1 is typical of a joint which uses an O-ring seal. A header 10 has a pocket or U-shaped channel 12 formed near its periphery and the tank 14 has an enlarged rim or foot 16 which fits within the channel 12. The foot 16 is offset toward the outside of the tank and has an outer shoulder 18. The channel has an inner wall 20 and an outer flange 22 joined by a bottom 24. A gasket 26 in the form of an O-ring is compressed between the rim 16 and the bottom 24. The edge of the flange is crimped over the shoulder 18 to clamp the assembly together. The O-ring 26 is shown in its undeformed or relaxed state in dashed lines 26'. Gaskets of other cross sectional shapes are known for this purpose, e.g., a double bead, a rectangle, or an ellipse. An example of this style of joint is shown in the U.S. Pat. No. 4,041,594 to Chartet which uses a rectangular cross section gasket and No. 4,316,503 to Kurachi et al which discloses an O-ring. The scheme of using a readily deformable seal such as an O-ring has the advantage that even when made with a hard rubber only moderate forces are needed during assembly to compress the gasket into a good sealing engagement and into conformity to the provided channel space prior to crimping the flange over the shoulder 18. However the space between the foot 16 and the inner wall 20 defines a crevice 28 which will accelerate corrosion attack of the header through creation of an oxygen depletion cell. Aluminum headers are particularly susceptible to this attack. Moreover, a manufacturing problem is that the low cross sectional properties of an O-ring gasket result in a part that is difficult to handle and properly place into the header prior to assembly. Twisting of the O-ring is a common problem.

A common approach to the header-tank seal design is typified by the two seal point configuration shown in FIG. 2. The tank 14 differs from the tank of FIG. 1 in that the heel 30 or inner curve formed at the offset of the foot or rim 16 is positioned close to the wall 20 of the header 10 to define a narrow gap between the heel 30 and the wall 20. Another difference is that the foot has a bead 32 projecting toward the bottom 24 of the channel. The gasket 34 has a rectangular section 36 lying in the bottom of the channel 12 and a tail portion 38 extending through the space between the foot 16 and the wall 20. The relaxed form 34' of the seal is shown in dashed lines. The gasket forms two seals, one between the heel 30 and the wall 20 to prevent the corrosion pocket found in the FIG. 1 design and the other where the bead compresses the rectangular portion 36. The gasket material comprises low durometer elastomers to minimize the force requirements in compressing the gasket during assembly. Also the bead 32 assures that sealing occurs at low gasket compression levels and controls gasket position and material flow during assembly. At high gasket compression levels this bead increases the tendency for the gasket to split under the bead. The gasket extrusion during assembly raises the force required to compress the gasket and also increases the stress level of the gasket material which will reduce the retained physical properties (compression set and recovery) of the gasket. The U.S. Pat. No. 4,289,507 to Cadars et al is an example of this style of seal arrangement.

SUMMARY OF THE INVENTION

It is therefore an object of the invention to provide a tank and header assembly having a sealed joint free from a corrosion inducing crevice and also permitting low gasket compression forces during assembly.

It is another object to provide such an assembly allowing the use of high durometer gasket material with superior retained physical properties and improved gasket handling properties.

The invention is carried out in a heat exchanger having a tank sealingly secured to a header, the seal assembly comprising; a tank foot having an end surface and an outer shoulder, a peripheral header channel configured to receive the tank foot and formed in a U-shaped cross section having an outer flange for gripping the shoulder of the foot, an inner wall opposed to the flange and spaced from the foot, and a bottom between the flange and the wall, the bottom being opposed to and spaced from the end surface of the foot, and a one-piece gasket of elastomeric material having a first seal portion including an enlarged rib compressed between the bottom and the end surface and a second seal portion extending between the inner wall and the foot, the rib, when relaxed, having a thickness greater than the space between the bottom and the end surface and a width less than the width of the bottom, whereby the first seal portion forms a secure seal with moderate clamping pressure due to the deformability of the enlarged rib and the second seal portion excludes fluid from the space between the wall and the foot of the tank.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE PREFERRED EMBODIMENT

Figure 3:
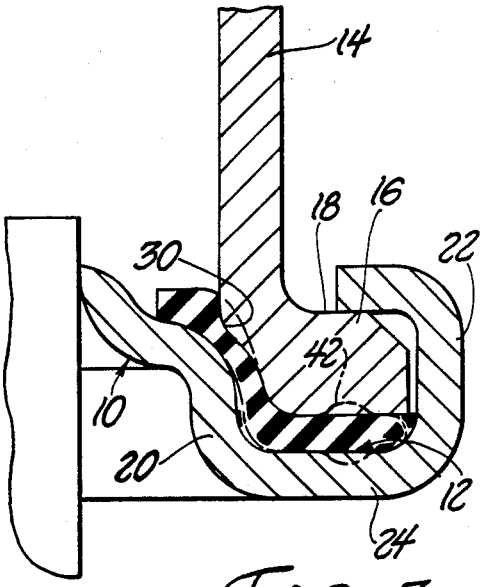
FIG. 3 is a cross section of a header -tank joint assembly in accordance with the invention.
Figure 4:
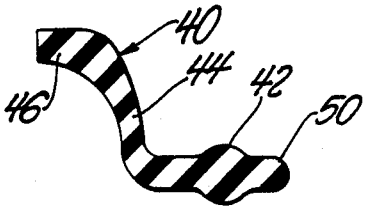
Fig. 4 PRIOR ART
FIGS. 4 and 5 are cross sections of gaskets for use in the joint of FIG. 3 according to the invention.
Figure 2:
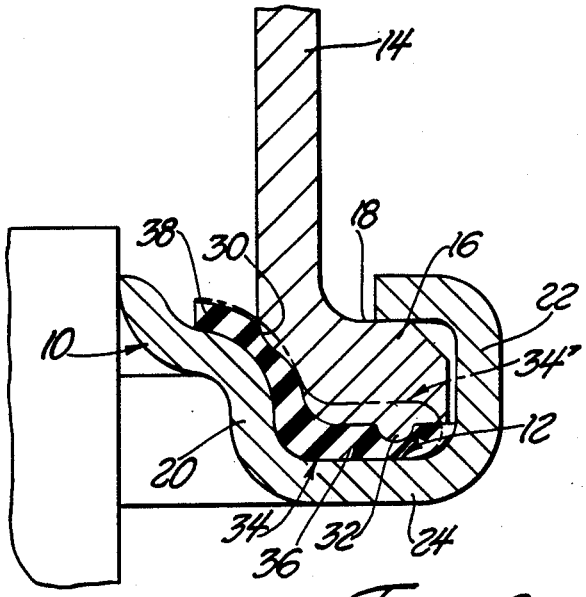

As revealed in FIG. 3, the joint assembly for attaching a header plate 10 to a tank 14 with an intervening gasket includes a channel or pocket 12 formed in the plate 10 to receive the rim or foot 16 of the tank 14. The channel 12 comprises a wall 20 opposite the inner side of the foot 16, a flange 22 opposite the outer side of the foot 16 and a bottom portion 24 joining the wall 20 and the flange 22. The tank 14 is configured like that of FIG. 2 with a heel 30 closely spaced from the wall 20 to insure sealing engagement with the gasket 40. The end surface of the foot lacks the bead 32 of FIG. 2 and is preferably flat or gently curved. As best seen in FIG. 4 which depicts the gasket in the relaxed state, the gasket 40 has an enlarged rib 42 integral with a web 44, and the web 44 is substantially thinner than the rib 42. The rib 42 is like an O-ring positioned between the foot 16 and the bottom portion 24. The web 44 extends from the rib 42 up between the foot 16 and the wall 20, and terminates in a tail 46 which lies, in part, beside the heel 30. Thus the tail must be sufficiently thick to assure a secure seal between the heel 30 and the wall 20 and thereby prevent corrosive action in the region between the foot 16 and the wall 20. The gasket forms a seal not only in the regions of the heel 30 and the rib 42 but also preferably throughout the extent of the gasket along the channel bottom portion 24 and the wall 20.

Figure 5:
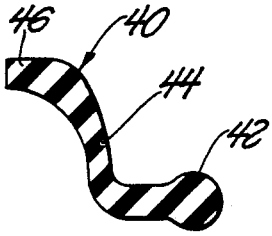

When assembled, the rib is compressed and flattened between the bottom portion 24 and the foot 16 to form a tight seal without danger of being weakened or split. It is preferred that the gasket be made with a high durometer elastomer so that it will have excellent physical properties. The rib, like an O-ring is relatively easy to compress. Thus, even though it is a hard material the O-ring configuration allows the rib to be compressed at low or moderate assembly forces to obtain a good seal without imposing high stresses on the gasket or on the tank and header. A tab 50 outboard of the rib 42 serves as a locator when the gasket is placed into the channel thereby assuring proper alignment of the gasket in the channel. The tab is optional so that the gasket configuration shown in FIG. 5 may be used instead.

The rib 42 on the gasket 40 is preferably of an O-ring configuration but it will be appreciated that other shapes may be chosen for the enlarged rib. For example, the rib may have triangular or elliptical form. Also, the rib may project beyond the web surface on one side rather than both sides. Multiple ribs may be used as well.

During assembly, the tank is pressed against the gasket 40 in the channel 12 and the flange 22 is clinched over the shoulder 18 on the rim or foot 16. As the space between the foot and the bottom of the channel decreases the gasket material deforms and flows from the rib to fill the space. The gasket 40, the foot 16 and the header pocket or channel 12 are designed to allow sufficient volume for gasket deformation during assembly so that the pocket is filled but extrusion of the gasket is minimized. This significantly reduces the force required to squeeze the gasket to finished dimension without degrading sealing performance. By choosing the web thickness, the clinch dimension at which the joint region is completely filled with gasket material can be controlled. When the space becomes full the force required for further compression of the joint increases significantly. Detection of the force increase would allow feedback control of the crimping operation.

Figure 1:
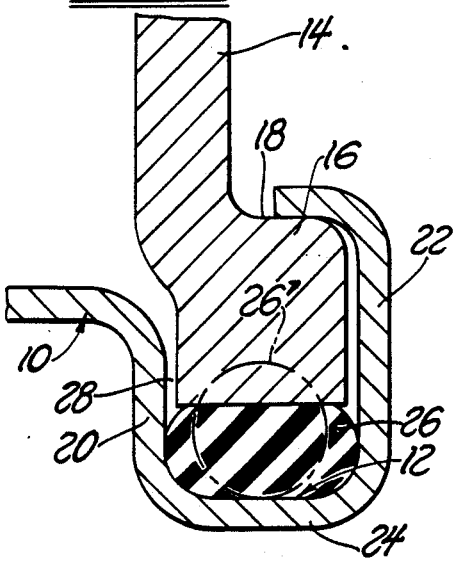
FIGS. 1 and 2 are cross sectional views of prior art header -tank joint assemblies.

Preferably, the gasket 40, the foot 16 and the channel 12 are designed with nominal dimensions so that the gasket goes solid (does not extrude where it is sandwiched between the foot and channel) when deformed to fill the pocket with a minimum gasket compression that gives good sealing at these dimensions so that only a minor amount of extrusion (for example 2.6%) can then occur at the nominal gasket compression and still only an insignificant amount (for example 17.4%) at the maximum gasket compression for the full dimensional tolerance range of these parts. This is to be compared with conventional designs as in FIGS. 1 and 2 that experience for example 22%, 35% and 45% extrusion with minimum, nominal and maximum gasket compressions that cover the full ranges of dimensional tolerances of the related parts.

It will thus be seen that the improved joint assembly provides the advantages of a complete seal to prevent corrosion problems, low or moderate clinch forces which avoid harmful stresses in all the parts, and allows the use of a high durometer elastomer with good compression set and tear strength properties. In addition, the gasket itself is easy to handle during assembly due to the hardness of the elastomer and the gasket cross section.

The embodiments of the invention in which an exclusive property or privilege is claimed are defined as follows:

1. In a heat exchanger having a tank sealingly secured to a header, the seal assembly comprising;

a tank foot having a flat end surface and an outer shoulder a peripheral header channel configured to receive the tank foot and formed in a U-shaped cross section having an outer flange for gripping the shoulder of the foot, an inner wall opposed to the flange and spaced from the foot, and a bottom between the flange and the wall, the bottom having a flat surface opposed to and spaced from the flat end surface of the foot, and a one-piece gasket of elastomeric material having a first seal portion including an enlarged rib compressed between the flat bottom surface and the flat end surface and a web-like second seal portion extending from the rib into the space between the inner wall and the foot, said gasket being sandwiched between said foot and channel and compressed by crimping an edge of said outer flange over said outer shoulder, the rib, when relaxed, having a thickness greater than the web-like portion and greater than the space between the bottom and the end surface and a width less than the width of the bottom, whereby the first seal portion forms a secure seal with moderate clamping pressure due to the deformability of the enlarged rib and the second seal portion excludes fluid from the space between the wall and the foot of the tank, said rib comprising an O-ring of symmetrical cross section integral with the web-like second seal portion and extending along the periphery of the gasket and toward the flange, and said gasket and foot and channel being configured with nominal dimensions determined so that said gasket does not extrude from between said foot and channel at a predetermined minimum gasket compression and extrudes only an insignificant amount at a predetermined maximum gasket compression that is determined to account for expected variations from said nominal dimensions.

2. The invention as defined in claim 1 wherein the foot has a heel portion projecting toward the wall and spaced from the wall by an amount less than the relaxed thickness of the second seal portion so that when assembled the second seal portion forms a seal between the foot and the wall.

3. The invention as defined in claim 1 wherein said gasket further includes locating tab means outboard of and integral with the O-ring and forming the periphery of the gasket for cooperating with the flange by contact therewith to positively insure location of the O-ring fully between the flat bottom surface and flat end surface during gasket assembly.

* * * * *